US005205702A

United States Patent [19]

Varwig

[11] Patent Number: 5,205,702

[45] Date of Patent: Apr. 27, 1993

[54] DEVICE FOR INTRODUCING ROLLED-STEEL SECTIONS INTO A COLD SHEAR

[75] Inventor: Karlheinz Varwig, Mülheim, Fed. Rep. of Germany

[73] Assignee: Mannesmann Aktiengesellschaft, Dusseldorf, Fed. Rep. of Germany

[21] Appl. No.: 769,086

[22] Filed: Sep. 30, 1991

[30] Foreign Application Priority Data

Oct. 9, 1990 [DE] Fed. Rep. of Germany ..... 4032335

[51] Int. Cl.[5] ..... B25J 15/06

[52] U.S. Cl. ..... 414/751; 198/468.5; 271/18.1; 294/65.5; 901/40

[58] Field of Search ..... 414/751, 737, 746.7, 414/740.8; 901/40; 294/65.5; 271/18.1; 198/468.5, 468.4, 464.3

[56] References Cited

U.S. PATENT DOCUMENTS 2,895,733 7/1959 Powers ..... 271/18.1
4,183,427 1/1980 Tomikawa ..... 198/468.4
4,820,114 4/1989 Inaba et al. ..... 414/751

FOREIGN PATENT DOCUMENTS 63-143135 6/1988 Japan ..... 271/18.1

*Primary Examiner*—Michael S. Huppert
*Assistant Examiner*—Donald W. Underwood
*Attorney, Agent, or Firm*—Cohen, Pontani, Lieberman, Pavane

[57] ABSTRACT

Apparatus for introducing rolled steel into the entrance of a processing machine such as a cold shear or straightening machine including a roller path for carrying the steel sections at a speed of transport in a direction of transport toward one of the shear and straightening machine. The apparatus comprising: a carriage arranged above the roller path and comprising a drive for moving the carriage along the direction of transport at a speed; structure connected to the carriage for holding down the steel sections; and a holding device comprising a lift magnet mounted on the carriage and being displaceable with respect to the holding device along a predetermined path parallel to the direction of transport of the carriage, the lift magnet comprising structure for measuring the path of movement of the magnet along the path and for generating and transmitting a signal to the carriage drive as a function of the measured path for adapting the speed of movement of the carriage to the speed of transport of the steel sections.

7 Claims, 2 Drawing Sheets

DEVICE FOR INTRODUCING ROLLED-STEEL SECTIONS INTO A COLD SHEAR

FIELD OF THE INVENTION

The present invention relates to a device for threading metal sections/bars into the entrance of downstream processing machines.

BACKGROUND OF THE INVENTION

The present invention relates to a device for introducing rolled-steel sections into a cold shear or straightening machine after the sections have been collected into layers behind cooling beds. In these devices the layers of sections transported on a roller path in front of the straightening or shear machine are held down by a profiled hold-down roll, and are transported by a holding device which is moveable in the longitudinal direction of the section. The holding device hangs above the roller path and has a lift magnet with profiled ledges, capable of transporting the sections to the driver/entry point of the cold shear or strengthening machine in synchronism with the speed of transport of the roller path.

Operators of these devices are now increasingly requiring an automatic threading means for feeding and threading the pre-collected packages of metallic bars or profiles into the cold shear or straightening machines. A plant of this type is described in Federal Republic of Germany 38 18 745 A1, FIG. 7.

If the threading device of the above type is not used in combination with the upstream devices for holding the bars during the entire cooling process but if they are introduced or retrofitted, for instance, subsequently into existing downstream processing machines, there is the added problem of rearranging uneven bar packages so that a proper taking over of the profiles by the lifting magnet as well as the subsequent introduction of the bars into the shear or straightening machine is assured. In addition, there is the added requirement that upon the transportation of the bars, the speed of the lift magnet which holds the bar ends and the speed of the roller path are so adapted to each other that the bars are not accelerated or decelerated with respect to the magnet by the friction against the rollers of the roller path. If this were to occur the bars would shift with respect to each other or drop out.

SUMMARY OF THE INVENTION

An object of the present invention is to provide an apparatus for introducing the rolled steel sections into downstream processing machines such as cold shear or straightening machines which can subsequently, be incorporated in existing plants and which are dependable in guiding the steel-bar layers.

To achieve this objective, it is proposed, in accordance with the present invention, that a hold-down roll and a holding device be arranged on a common carriage, so that a lift magnet is displaceable with respect to the holding device along a limited path parallel to the path of transport of the carriage. Moreover, a path measuring or a tracking device is provided which via a computer gives off signals, as a function of the measured path, to the drive of the carriage in order to adapt the speed of the carriage to the speed of the material.

An advantage of the proposal in accordance with the invention is that even asymmetrical sections such as, for instance, angles which are known to stand upwards at their ends after the cooling process (ski effect), can be brought into the required position before further processing by the profiled hold-down roll. The hold-down roll is arranged on the carriage and displaceable therefrom so that the hold-down roll can press the sections down before the sections engage with the magnet. Furthermore, assurance is had that the speed of the bar layer coincides in each case with the speed of the magnet arranged on the carriage or on the holding device in a manner wherein the magnet is displaceable on the holding device and the path of displacement is used as the measure and the signal for controlling the carriage drive.

In a preferred embodiment of the invention, the lift magnet is brought into a central position of displacement with respect to the holding device, after switching off the magnet and releasing the layer of bars. The above can be achieved, for instance, by means of springs. As a consequence of the displaceability of the lift magnet, a tearing off or shifting of the bars on the magnet is dependably prevented.

BRIEF DESCRIPTION OF THE DRAWINGS

The present invention will be further explained in more detail below with reference to the drawings, in which.

DETAILED DESCRIPTION OF THE PRESENTLY PREFERRED EMBODIMENTS

Figure 1:
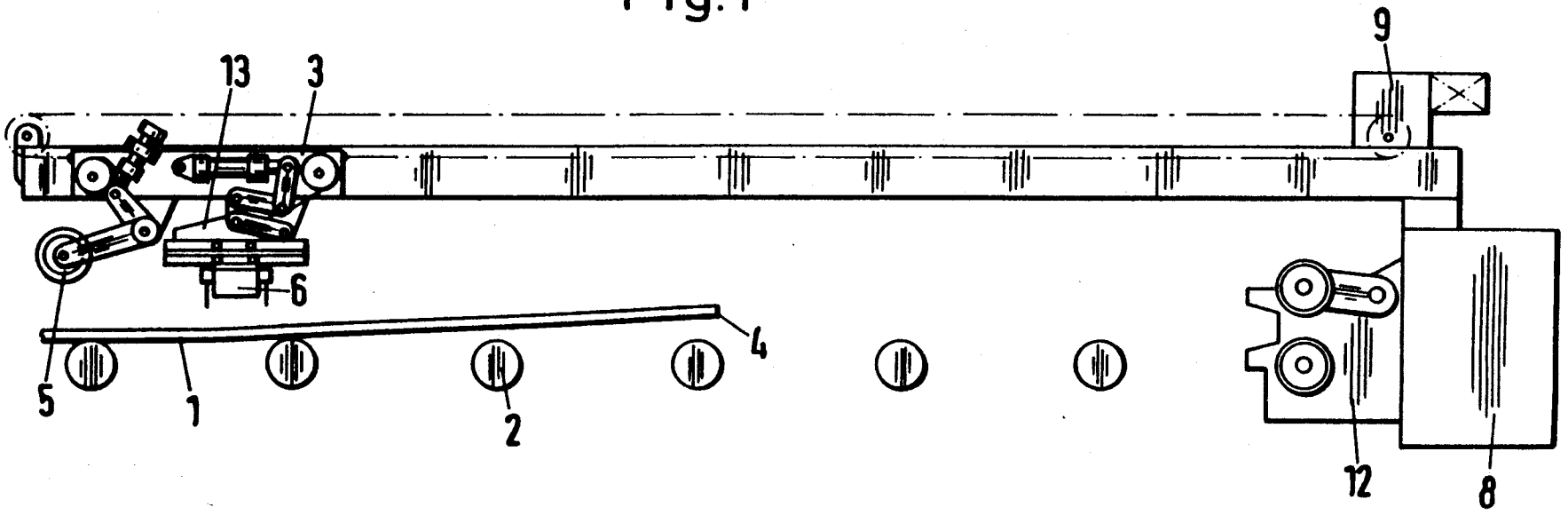
FIG. 1 shows the device of the invention in a side view after depositing the rolled-steel sections.

After placing a collected layer 1 of rolled steel sections on the straightening or cutting roller path 2, the carriage 3, on which both the lift magnet 6 on the holding device 13 and the profiled hold-down roll 5 are arranged, travels from its waiting position over the bar heads 4 into the region of the cooling bed just behind the start of the curvature of the bar. There, the profiled hold-down roll 5 is lowered onto the rolled-steel sections 1 and the carriage 3 moves in a direction towards the front end 4 of the bar. Bars standing on end or horizontally curved bars are thus brought to the predetermined distance apart and, at the same time, pressed down.

Figure 2:
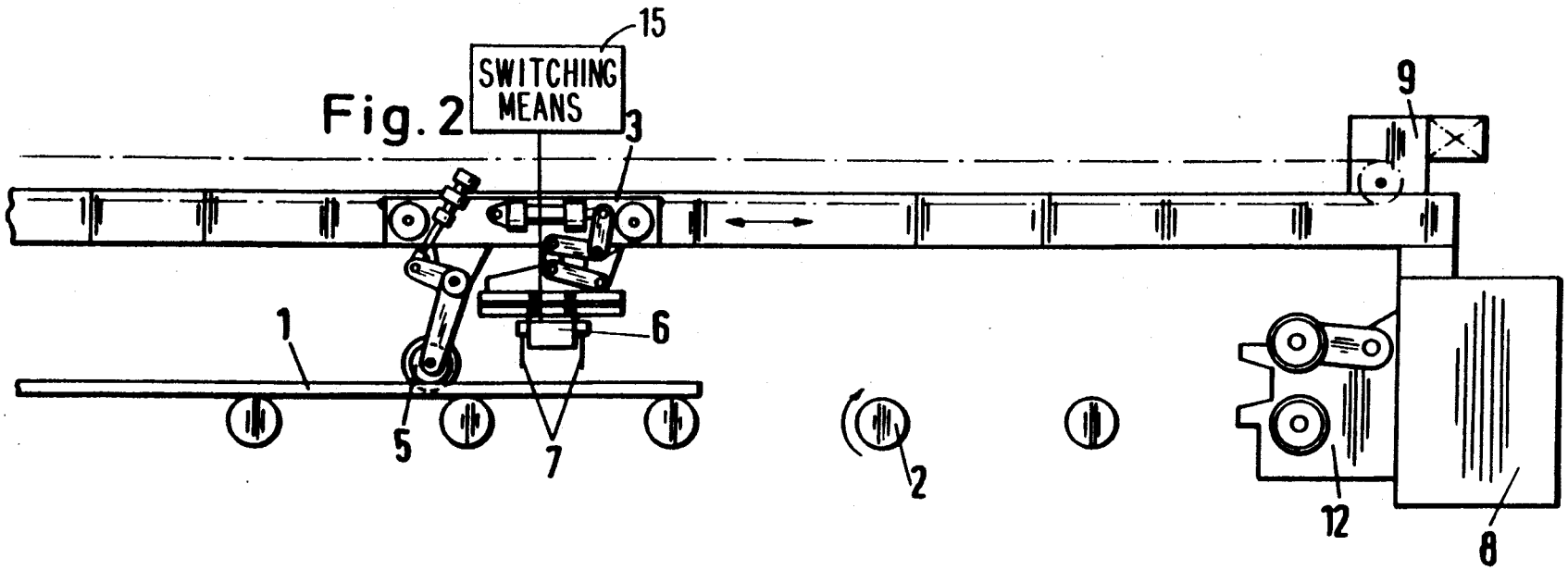
FIG. 2 shows a view similar to FIG. 1 but wherein the hold-down roll has moved downward shortly before the lift magnet is engaged.

The magnet 6 is positioned above the bar package so that the bars protrude beyond the magnet by a desired amount in the direction of transport which is necessary for the bars to be threaded into the cold shear or strengthening machines. The carriage 3 is then switched off and the magnet 6 having profiled ledges 7 is lowered until it comes to lie on the bars and is switched on by switching means 15 shown in FIG. 2.

The profiled roll 5 is then moved into its upper position and the magnet then lifts the bar heads by about 10 to 20 mm off from the roller path.

Drive 9 of carriage 3 together with the drive of the roller path is then turned on so as to urge the bars on the roller path in the direction towards the straightening machine or shear 8. The acceleration of carriage 3 is predetermined and set electrically in accordance with the expected theoretical acceleration of the material by the roller path 2. The acceleration and deceleration are determined by the coefficient of friction between the roll and the bar material.

Figure 3:
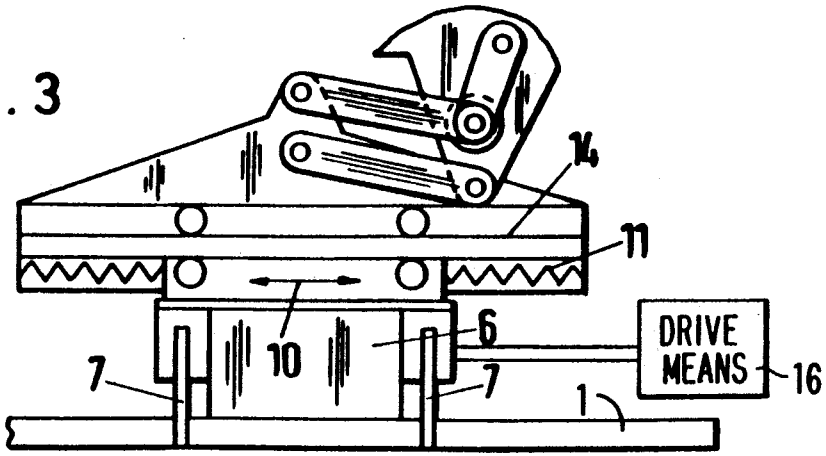
FIG. 3 shows the holding device together with the lift magnet, in an enlarged view.

The magnet 6 being provided with replaceable profile ledges is arranged for reciprocating displacement on the carriage 3 in and opposite the direction of transport along a guide 14 so that, in the event of differences in speed, the drive of the carriage is continuously adapted to the speed of the material via an electric path measurement device 10 (FIG. 3). The electric control is so designed that the magnet continuously strives for the central or zero position during synchronized control. In an unloaded condition, return springs 11 or cylinders provide that the magnet is always in zero position. The carriage with the activated magnet 6 introduces the bar heads 4 into shear 8 or driver 12, then releases the magnet 6 after transfer, and, with the magnet raised, moves back into its parking position in front of the cooling bed.

The lift magnet 6 can be moved in a direction transverse to the direction of transport by drive means 16 shown in FIG. 3.

It should be understood that the preferred embodiments and examples described are for illustrative purposes only and are not to be construed as limiting the scope of the present invention which is properly delineated only in the appended claims.

What is claimed is:

1. An apparatus for feeding and introducing rolled steel sections into a cold shear or straightening machine including a roller path for carrying said steel sections and for transporting said steel sections at a speed of transport in a direction of transport toward one of said shear and straightening machine, said apparatus comprising:

a carriage arranged above said roller path and comprising a drive for moving said carriage along said direction of transport at a speed;

means connected to said carriage for holding down said steel sections; and a holding device comprising a lift magnet mounted on said carriage, said magnet being displaceable on said holding device relative to said holding device along a predetermined path parallel to said direction transport of said carriage, said lift magnet comprising means for measuring the displacement of said magnet along said predetermined path relative to said holding device and for generating and transmitting a signal to said carriage drive as a function of said displacement for adapting said speed of movement of said carriage to said speed of transport of said steel sections.

2. The apparatus according to claim 1, additionally comprising a guide at said holding device for guiding said lift magnet along said path parallel to said roller path; means connected to said lift magnet for switching off said magnet; and means for returning said magnet into a central position on said guide after the magnet has been switched off.

3. The apparatus according to claim 1, wherein said holding device additionally comprises profiled ledges for engaging said steel sections.

4. The apparatus of claim 3, wherein said profiled ledges are removable.

5. The apparatus according to claim 2, wherein said means for returning said magnet comprises a push-pull device.

6. The apparatus according to claim 5, wherein said push-pull device comprises a spring.

7. The apparatus according to claim 1, additionally comprising means for moving said lift magnet in a direction transverse to said direction of transport.

* * * * *